US005735247A

United States Patent [19]

Tsuzuki et al.

[11] Patent Number: 5,735,247

[45] Date of Patent: Apr. 7, 1998

[54] FUEL DELIVERY SYSTEM WITH IMPROVED FUEL LEAKAGE PREVENTION

[75] Inventors: Touji Tsuzuki; Isamu Suzuki, both of Obu, Japan

[73] Assignee: Aisan Kogyo Kabushiki Kaisha, Obu, Japan

[21] Appl. No.: 807,537

[22] Filed: Feb. 28, 1997

[51] Int. Cl.[6] ..... F02M 37/04

[52] U.S. Cl. ..... 123/470; 123/468; 123/456

[58] Field of Search ..... 123/470, 456, 123/472, 468, 469, 198 D

[56] References Cited

U.S. PATENT DOCUMENTS

| | | | |
|---|---|---|---|
| 4,240,385 | 12/1980 | Kulke | 123/470 |
| 4,922,958 | 5/1990 | Lemp | 123/456 |
| 4,979,295 | 12/1990 | Stagni | 123/470 |
| 5,044,340 | 9/1991 | Robnett | 123/470 |
| 5,363,825 | 11/1994 | Becker | 123/456 |
| 5,520,151 | 5/1996 | Gras | 123/470 |
| 5,531,202 | 7/1996 | Lorraine | 123/456 |
| 5,598,824 | 2/1997 | Treusch | 123/456 |

FOREIGN PATENT DOCUMENTS

| | | | |
|---|---|---|---|
| 0246465 | 10/1988 | Japan | 123/468 |
| 3-39194 | 6/1991 | Japan . | |
| 4124462 | 4/1992 | Japan | 123/468 |
| 6280712 | 10/1994 | Japan | 123/468 |

*Primary Examiner*—Carl S. Miller

*Attorney, Agent, or Firm*—Dennison, Meserole, Pollack & Scheiner

[57] ABSTRACT

A fuel delivery system for delivering fuel to an engine comprises a pipe having a fuel passage and a plurality of fuel injector mounting holes each communicating with the fuel passage, a plurality of fuel injectors each mounted on each fuel injector mounting hole, and a fixing portion having a weak portion for fixing the pipe to the engine. Each fuel injector mounted on the pipe is positioned in a predetermined positional relation with respect to the engine when the pipe is fixed to the engine at the fixing portion.

7 Claims, 9 Drawing Sheets

FUEL DELIVERY SYSTEM WITH IMPROVED FUEL LEAKAGE PREVENTION

BACKGROUND OF THE INVENTION

1. Field of the Invention

This invention generally relates to improvements of a fuel delivery system for delivering fuel to a multi-cylinder engine, and more particularly to a fuel delivery system with improved fuel leakage prevention even in an abnormal situation.

2. Description of the Prior Art

An example of conventional fuel delivery systems for delivering fuel to a multi-cylinder engine is disclosed in Japanese Patent Publication No. 3-39194. This system comprises a fuel delivery pipe having a fuel passage formed along its axis. The pipe has a plurality of fuel injector mounting holes with which the fuel passage is communicated. The fuel injector mounting holes are provided in the same number as that of the cylinders of the engine. Each fuel injector mounting hole has a fuel injector mounted thereon. The pipe is fixed at fixing portions to the engine. When the pipe is fixed at the fixing portions to the engine, each fuel injector mounted on the pipe is positioned with respect to each cylinder of the engine in a predetermined positional relation. The fuel fed from the fuel passage is supplied from each fuel injector to each cylinder. The engine referred to in this specification is a cylinder head or an intake manifold of the engine.

With this conventional fuel delivery system, when a very large force acts between the engine and the pipe, there is a possibility that the pipe is broken resulting in fuel leakage. Particularly, when the pipe is formed of synthetic resin or aluminum alloy, the pipe is easily broken.

SUMMARY OF THE INVENTION

In order to prevent the breakage of the pipe, the pipe must be very strong. However, strength of the pipe has a limitation and the pipe is broken to cause fuel leakage practically when a force over a fracture strength acts on the pipe. Further, in order to make the pipe strong, high production cost is required and the pipe becomes heavy.

An object of the present invention is to realize a technique for preventing breakage of a pipe, without increasing the strength of the pipe, even when a very large force acts between the pipe and an engine.

In this invention, a weak portion is provided at a fixing portion for mounting the pipe to the engine. Here, a fracture strength of the weak portion is set to be lower than that of the pipe. Further, the mounting strength of a fuel injector to the pipe is set to be higher than the mounting strength of the fuel injector to the engine.

By being set in the above-described relation, the fixing portion is broken before the pipe is broken in a case that a large force acts between the engine and the pipe. Once the fixing portion is broken, no further force acts between the engine and the pipe, thus preventing the breakage of the pipe.

With this construction, the fuel injector is not removed from the pipe even if the fuel injector is displaced with respect to the engine (or removed from the engine in the worst case), thus preventing the leakage of the fuel from the pipe. The fuel injector has a valve therein, and the fuel is prevented from being released to the outside of the pipe by the valve. If the valve of the fuel injector is opened accidentally, the fuel is injected from the fuel injector. However, the valve of the fuel injector is not opened in such an abnormal situation when a very large force acts between the pipe and the engine. Even if the valve is opened accidentally, the amount of the fuel injected from the fuel injector is incomparably smaller than the amount of the fuel which leaks out from the broken pipe.

The present invention will be more fully understood from the following detailed description and appended claims when taken with the accompanying drawings.

DETAILED DESCRIPTION OF THE PREFERRED EMBODIMENTS

Preferred Embodiments 1 to 7 of this invention will now be described.

A first embodiment of the present invention will be described with reference to FIGS. 1 to 4.

Figure 2:
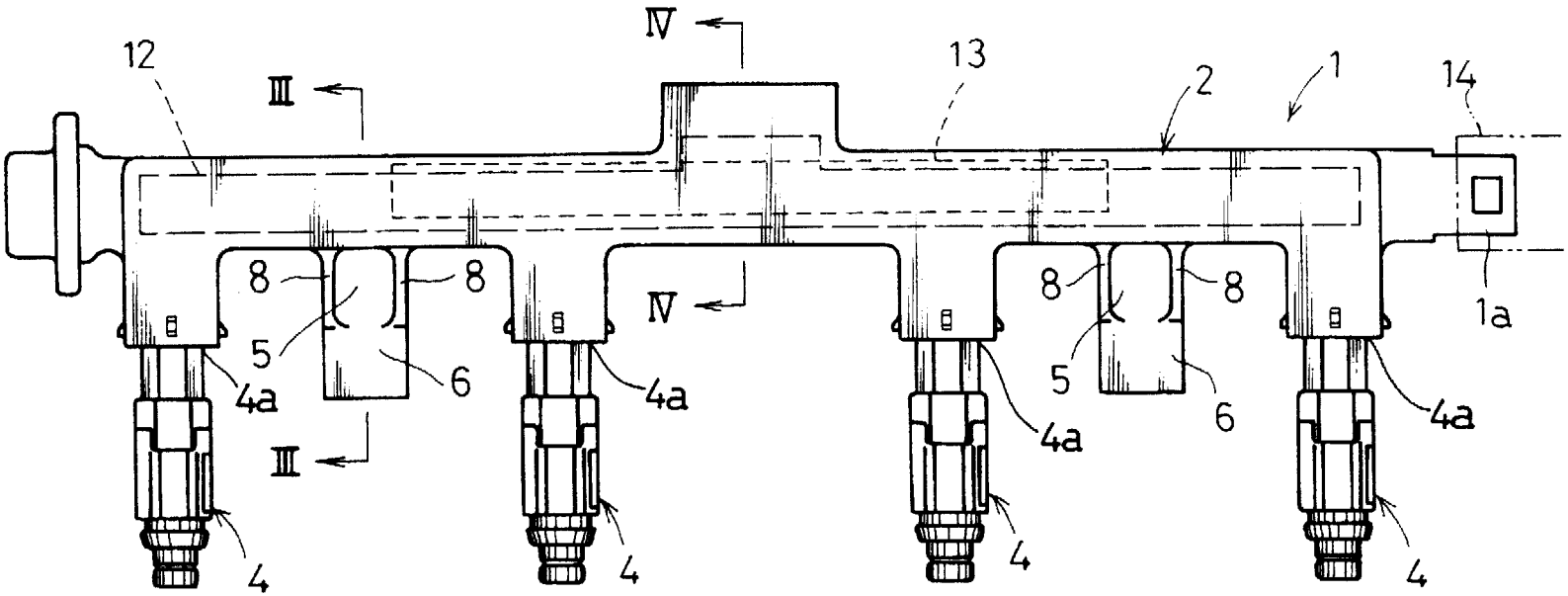
FIG. 2 is a front view of the fuel delivery system of FIG. 1.
Figure 3:
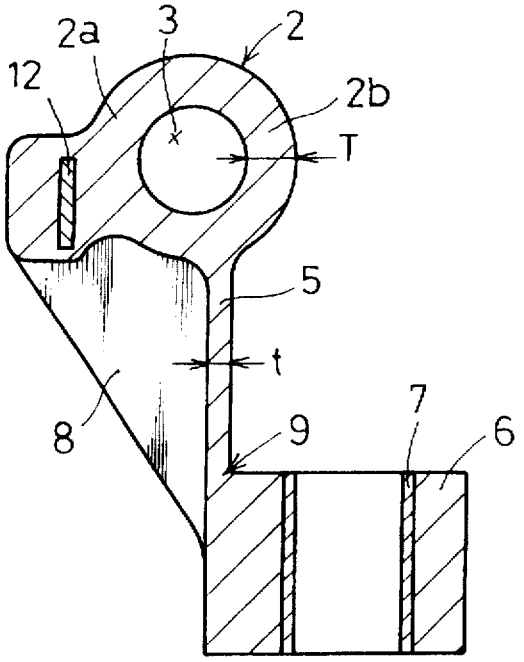
FIG. 3 is a cross-sectional view taken along line III—III of FIG. 2.
Figure 4:
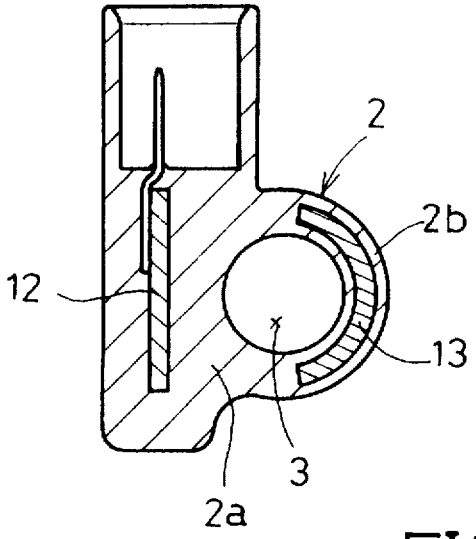
FIG. 4 is a cross-sectional view taken along line IV—IV of FIG. 2.

FIG. 2 is a front view and FIGS. 3 and 4 are cross-sectional views of a fuel delivery system taken along line III—III, and line IV—IV of FIG. 2, respectively.

The fuel delivery system comprises a fuel delivery pipe 1 and a plurality of fuel injectors 4. The fuel delivery pipe 1 has a substantially cylindrical pipe 2 and two sets of fixing portions 90. The pipe 2 is formed with a fuel passage 3 extending along the axis of the pipe 2. The fuel passage 3 is opened at one end of the pipe 2 where an inlet opening 1*a* is formed to introduce a high pressure fuel into the fuel passage 3. The inlet opening 1*a* of the fuel delivery pipe 1 is connected to a fuel supply hose 14. The pipe 2 has a plurality of fuel injector mounting holes 4*a* formed on its side surface. Each fuel injector mounting hole 4*a* is communicated with the fuel passage 3 and is formed at a position corresponding to each intake pipe for each cylinder. Each fuel injector mounting hole 4*a* has the fuel injector 4 mounted thereon. The fuel delivery pipe 1 introduces the high pressure fuel from the inlet opening 1*a* and delivers the fuel passage 3 to fuel injectors 4. Each fuel injector 4 injects the fuel into each intake pipe of the cylinder of the engine 11.

The fuel delivery pipe 1 has two mounting pieces 5 each projecting from a portion at the right and the left side of the pipe 2. A boss portion 6 is formed at each end of the mounting piece 5 for fixing the pipe 2 to the engine 11. A metal bush 7 is fitted in the boss portion 6 (see FIG. 3). The mounting piece 5 and the boss portion 6 constitute the fixing portion 90 to fix the pipe 2 to the engine 11.

As shown in FIG. 3, the wall thickness t of the mounting piece 5 is formed to be thinner than the peripheral wall thickness T of the fuel passage 3 of the pipe 2. The relation of t and T is set to "t=T/2". With this relation of t and T, the fracture strength of the mounting piece 5 is lower than that of the pipe 2. Specifically, the relation is set such that the pipe 2 is prevented from being broken by previously breaking the mounting piece 5 when a large force acts between the engine 11 and the pipe 2 while the pipe 2 is fixed to the engine 11 at the fixing portions 90. For this purpose, the fixing portion 90 is provided with a brittle portion 9 having a lower fracture strength than that of the pipe 2. Though the mounting piece 5 is reinforced by a pair of ribs 8, the fracture strength of the mounting piece 5 is lower than that of the pipe 2.

Figure 1:
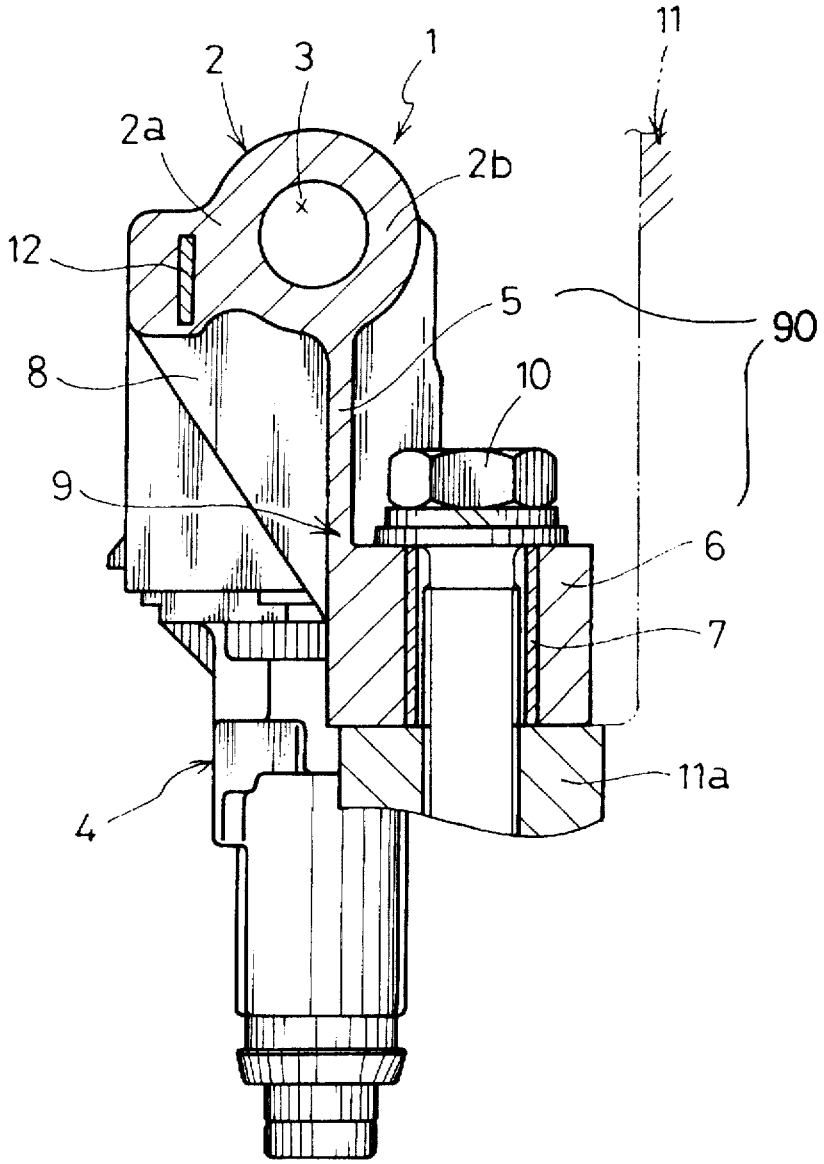
FIG. 1 is a side view, shown partially in cross-section, of a fuel delivery system of a first embodiment of the invention.

The delivery pipe 1 whose mounting structure is shown in FIG. 1 in partial cross-section is fixed such that the boss portion 6 is fixed to the engine 11 (a cylinder head 11*a* of the engine 11 or an intake manifold to be more exact) by a fixing bolt 10. One end (upper end) of the fuel injector 4 is firmly secured to the fuel injector mounting hole 4*a* of the pipe 2. The other end of the fuel injector 4 is mounted on the engine 11 by being inserted via an elastic sealing member into a mounting hole provided in a wall of the intake manifold of the engine. The mounting strength of the fuel injector 4 with respect to the pipe 2 is higher than the mounting strength of the fuel injector 4 with respect to the engine 11.

The fuel delivery pipe 1 has a printed board 12 insert-molded therein so as to electrically connect a connector to a plurality of fuel injectors 4. The printed board 12 is a rigid print board and disposed within a wall 2*a* of the pipe 2 on the side which is remote from the engine 11. The same effect is obtained by using a pressed connecting metal to electrically connect those members.

As shown in FIGS. 2 and 4, a long reinforcing metal plate 13 having a substantially semi-spherical cross-section is insert-molded in the pipe 2 between the right and left bosses 6. The spherical reinforcing plate 13 is disposed in a wall 2*b* facing the engine 11.

The fuel delivery pipe 1 with the above-described construction is integrally formed of injection-molded products such as synthetic resins or their composite materials with excellent heat and electricity insulating properties.

With the above-described fuel delivery system, when an abnormally large force is applied between the engine 11 and the fuel delivery pipe 1 by a car crash or the like, the weak portion 9 of the mounting piece 5 arranged between the pipe 2 and the boss portion 6 is broken first, thus preventing breakage of the pipe 2 of the fuel delivery pipe 1, and further preventing fuel leakage.

The fuel injector 4 is firmly fixed to the delivery pipe 1 via an o-ring by a snap-fitting to avoid its detachment. On the other hand, the fuel injector 4 is elastically mounted to the engine 11 via the sealing member by inserting the lower end of the fuel injector 4 into the mounting hole provided in the wall of the intake manifold of the engine 11. The fuel injector 4 is firmly mounted to the pipe 2, but elastically mounted to the engine 11 to be easily displaced with respect to the engine 11. Therefore, when a large force acts between the pipe 2 and the engine 11 to break the weak portion 9 and causes the displacement of the pipe 2 with respect to the engine 11, the fuel injector 4 is displaced together with the pipe 2, thus preventing the fuel injector 4 from being removed from the pipe 2. Even when the fuel injector 4 is removed from the engine 11, the fuel does not leak to the outside of the engine 11, since a valve is built in the fuel injector 4. In an abnormal situation such that a very large force acts between the pipe 2 and the engine 11, the valve in the fuel injector 4 is not opened. Even if the valve is opened accidentally, the amount of the fuel injected from the fuel injector 4 is incomparably smaller than the amount of the fuel which leaks out of the broken pipe 2.

The wall 2*a* of the pipe 2 which is remote from the engine 11 is reinforced by rigidity of the printed board 12. With this reinforcement, the wall 2*a* of the pipe 2 is effectively prevented from breakage. This reinforcing structure provides advantage in cost and weight compared with the case when a specific reinforcing part is separately added. Further, the pipe 2 is reinforced between the right and left bosses 6 by the reinforcing member 13 to prevent breakage of the wall 2*b* of the pipe 2.

Figure 5A:
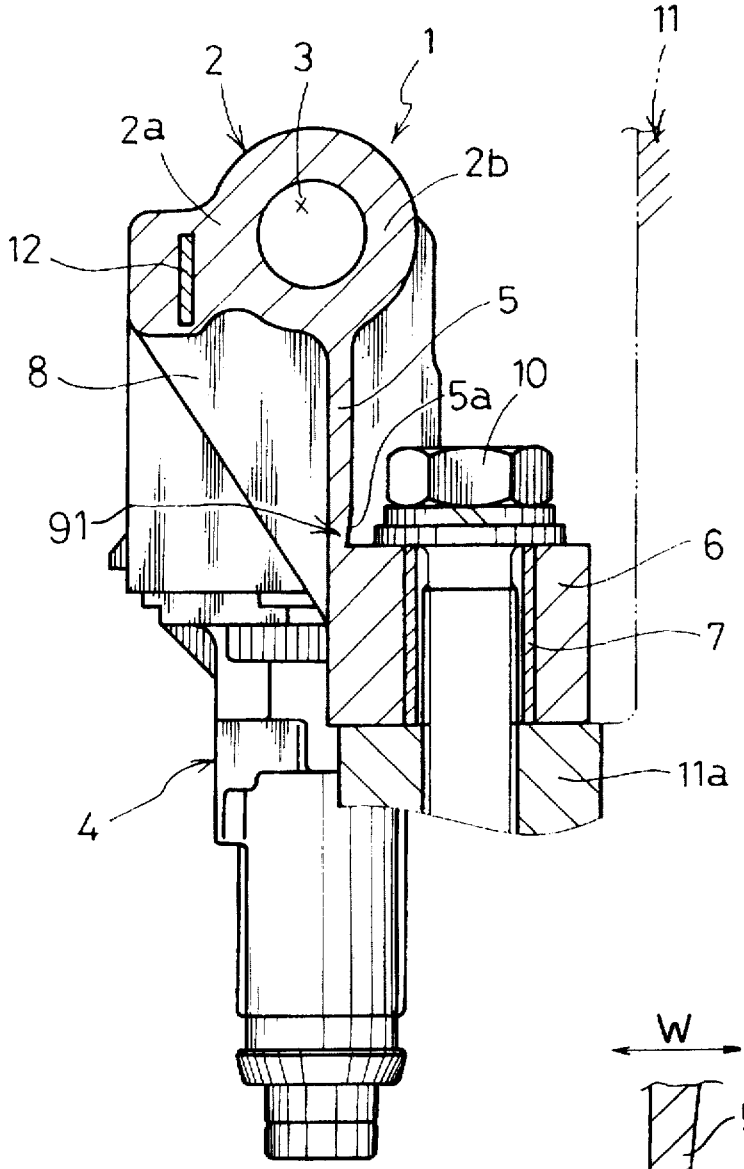
FIG. 5(A) is a side view, shown partially in cross-section, of a fuel delivery system of a second embodiment.
Figure 5B:
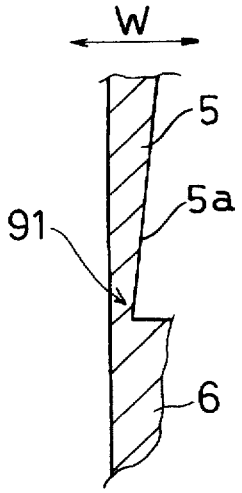
FIG. 5(B) is a partially enlarged view of FIG. 5(A)

Referring now to FIGS. 5(A) and 5(B), a second embodiment of the present invention will be described. FIG. 5(A) is a side view of a fuel delivery system shown partially in vertical cross-section and FIG. 5(B) is an enlarged view of the essential part of FIG. 5(A). The second to seventh embodiments are partial modifications of the first embodiment, and only the modified parts are described. Parts that are the same as or similar to those in the second embodiment are given like reference numbers, and their description will not be repeated.

This embodiment shows a modification of the weak portion 9 of the fuel delivery pipe 1. A weak portion 91 is formed such that an inclined plane 5*a* is provided at an end of the mounting piece 5 to gradually reduce in wall thickness of the piece 5 toward the boss 6. According to the fuel delivery system of the second embodiment, the weak portion 91 is easily broken by a force acting on the pipe 2 in a substantially transverse direction (a direction shown by the arrow in FIG. 5(B)), thus effectively preventing breakage of the pipe 2.

Figure 6A:
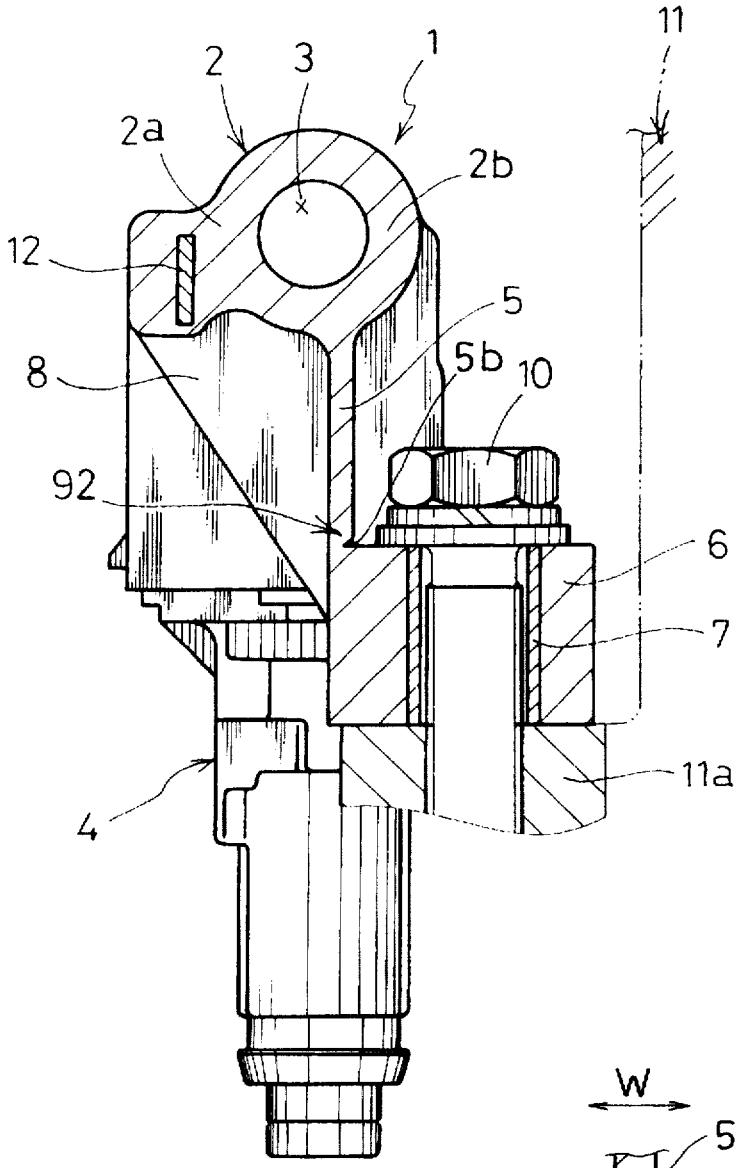
FIG. 6(A) is a side view, shown partially in cross-section, of a fuel delivery system of a third embodiment.
Figure 6B:
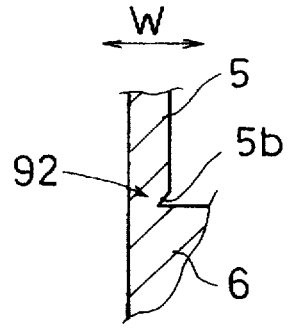
FIG. 6(B) is a partially enlarged view of FIG. 6(A)

Referring now to FIGS. 6(A) and 6(B), a third embodiment of the present invention will be described. FIG. 6(A) is a side view of a fuel delivery system shown partially in vertical cross-section and FIG. 6(B) is an enlarged view of the essential part of FIG. 6(A). This embodiment shows another modification of the weak portion 9 of the fuel delivery pipe 1. A weak portion 92 is formed into a notch 5*b* with a wedged cross-section in place of the inclined plane of the second embodiment. According to the fuel delivery system of the third embodiment, the same operation and effect as those of the second embodiment can be obtained.

Figure 7A:
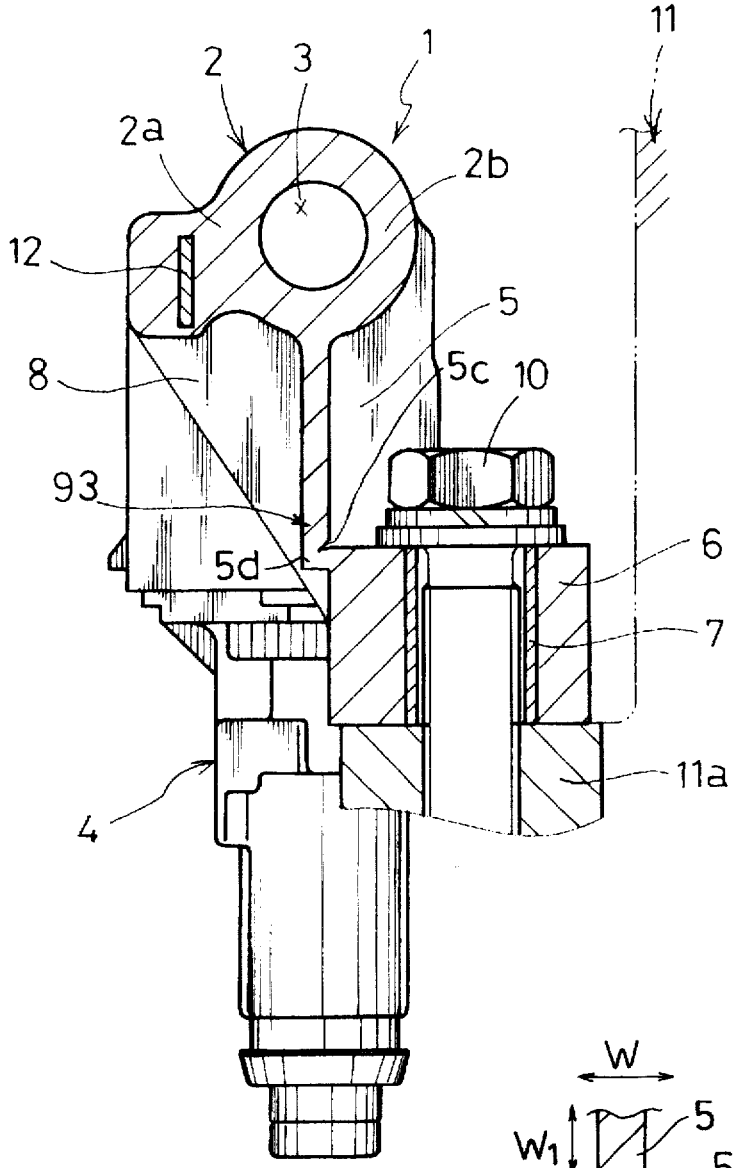
FIG. 7(A) is a side view, shown partially in cross-section, of a fuel delivery system of a fourth embodiment.
Figure 7B:
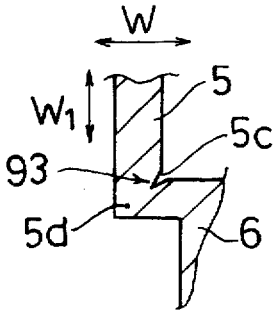
FIG. 7(B) is a partially enlarged view of FIG. 7(A)

Referring now to FIGS. 7(A) and 7(B), a fourth embodiment of the present invention will be described. FIG. 7(A) is a side view of the fuel delivery system shown partially in vertical cross-section and FIG. 7(B) is an enlarged view of the essential part of FIG. 7(A). This embodiment shows a further modification of the weak portion 9 of the fuel delivery pipe 1. A weak portion 93 is formed such that a step 5*d* with an L-shaped cross-section is provided at an end of the mounting piece 5 to be connected to the boss portion 6 and further, a notch 5*c* of a wedged shape is formed, as shown in FIG. 7 (B), from the inner corner of the step 5*d* in an obliquely downward direction. According to a fuel delivery system of this embodiment, the weak portion 93 is easily broken by a vertical force (a direction shown by an arrow W1 in FIG. 7(B)) besides by a transverse force (a direction shown by W in FIG. 7(B)), thus effectively preventing breakage of the pipe 2. The notch 5*c* may be formed on the other side of the step 5*d* (left side of the step 5*d* in FIG. (B)).

Figure 8:
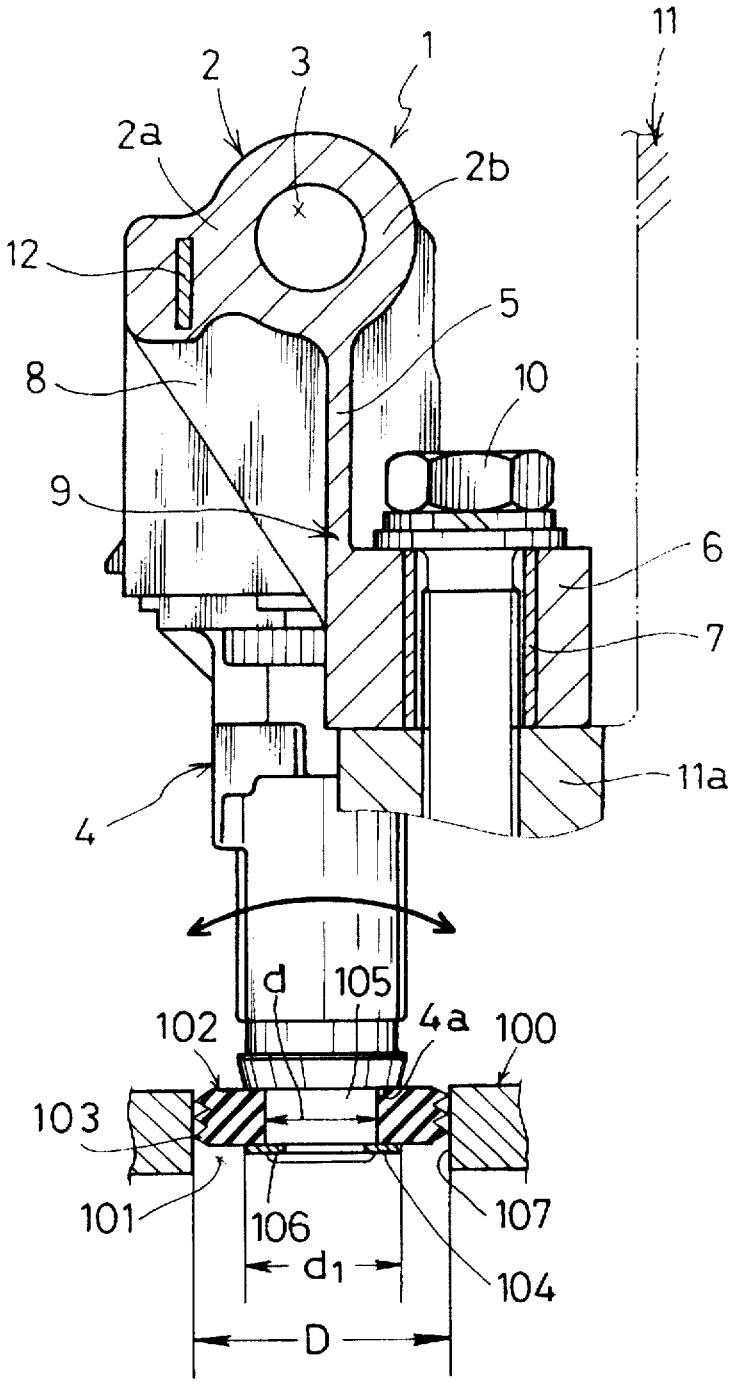
FIG. 8 is a side view, shown partially in cross-section, of a fuel delivery system of a fifth embodiment.

A fifth embodiment of the present invention will now be described with reference to FIG. 8. This embodiment relates to a fuel delivery system wherein a fuel delivery pipe of the first embodiment is used. In FIG. 8, an intake manifold 100 constituting an intake pipe of the engine 11 has a fuel injector mounting hole 101. The intake manifold 100 constitutes a part of the engine 11. A fuel injector may be mounted on a cylinder head in place of the intake manifold.

An elastic sealing rubber 102 of a ring-like plate is fitted at the lower end 105 of the fuel injector 4 to be inserted into the mounting hole 101. The sealing rubber 102 has a suitable number of beats (three beats are shown in FIG. 8) on its peripheral surface and supports the lower end 105 of the injector 4. The outer periphery of the lower end 105 is sealed by the inner peripheral surface of the sealing rubber 102, while the inner wall 107 of the mounting hole 101 of the intake manifold 100 is sealed by the outer peripheral surface of the sealing rubber 102. A top inner periphery of the sealing rubber 102 is in contact with an outer peripheral edge 4*a* of the fuel injector 4 and seals the edge 4*a*.

The sealing rubber 102 is prevented from removal by an engaging member 104 engaged at the lower end 105. The engaging member 104 is, for example, a snap ring which is elastically fitted into a concavity 106 of a snap fit.

The aperture D of the mounting hole 101 of the intake manifold 100 is determined to be considerably larger than the outer diameter d of the lower end 105 of the fuel injector 4, about 1.5 to 3 times larger, for example. Specifically, the lower end 105 of the fuel injector 4 is inserted into the mounting hole 101 to be pivotally movable on its inserted portion (see an arrow in a bold line in FIG. 8). Thus, the fuel injector 4 is mounted to be easily displaced with respect to the engine (removed from the engine in the worst case).

The outer diameter d1 of the engaging member 104 is smaller than the aperture D of the mounting hole 101 of the intake manifold 100. The engaging member 104 is made of resin material to avoid damage to an inner wall 107 of the mounting hole 101 when being tilted and directly in contact with the inner wall 107.

With the above-described fuel delivery system, when the weak portion 9 of the fuel injecting pipe 1 is broken and causes the fuel injector 4 to move with the pipe 2 with respect to the engine 11, the fuel injector 4 pivotally moves with respect to the mounting hole 101 of the intake manifold 100 (see the bold arrow in FIG. 8) because of the elastic deformation of the sealing rubber 102. With this pivotal movement, the fuel injector 4 can be easily removed from the mounting hole 101, thus easily preventing breakage of the fuel injector 4, and further preventing removal of the fuel injector 4 from the pipe 2 or displacement of the mounting position of the fuel injector 4 with respect to the pipe 2. Thus, fuel leakage from the fuel injector 4 or from between the pipe 2 and the fuel injector 4 is avoided.

Conventionally, the aperture D of the mounting hole 101 of the intake manifold 100 is determined to be slightly larger than the outer diameter d of the lower end 105 of the fuel injector 4 so that the lower end 105 is prohibited from pivotal movement with respect to the mounting hole 101. In conventional operation, when the weak portion 9 of the delivery pipe 1 is broken and causes the fuel injector 4 to move with the pipe 2, fuel leakage may be produced by the breakage or bending of the lower end 105 of the fuel injector 4. On the other hand, with the mounting structure of the fuel injector 4 of this embodiment, the above disadvantage is absent.

Figure 9:
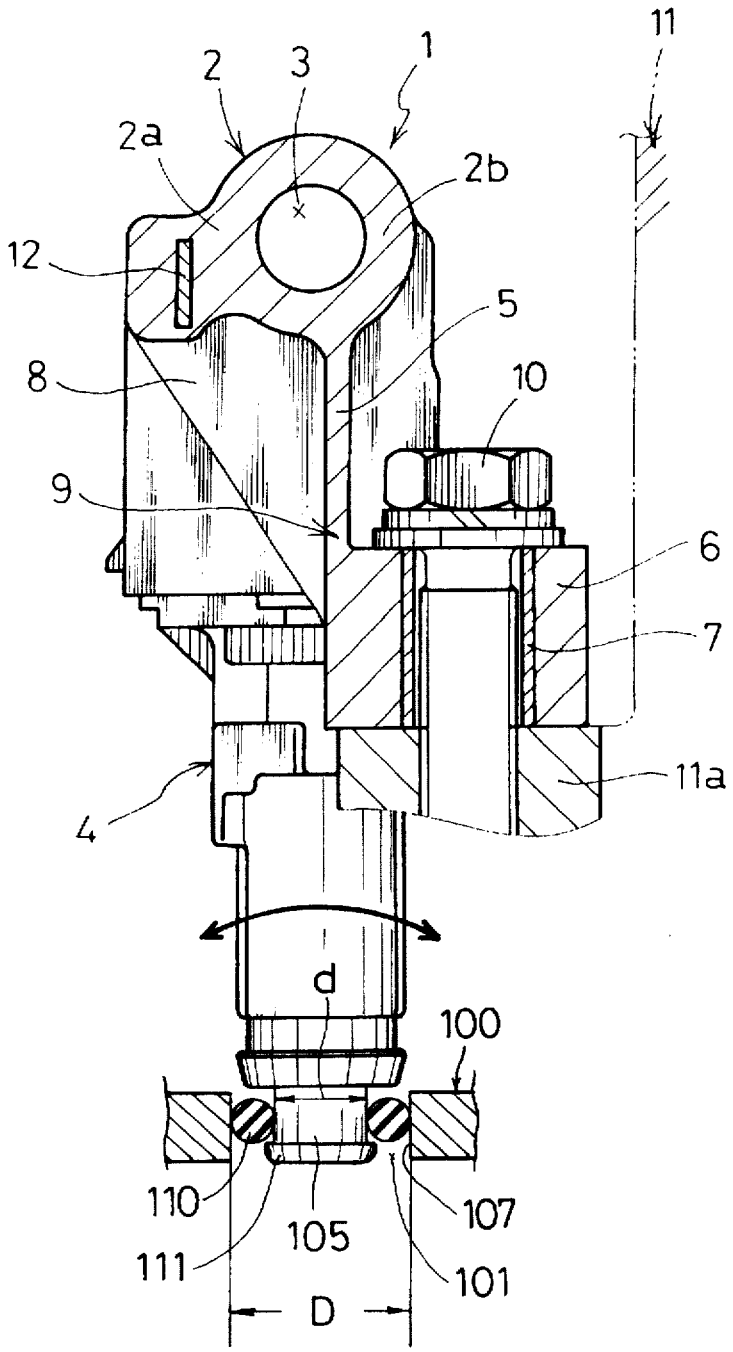
FIG. 9 is a side view, shown partially in cross-section, of a fuel delivery system of a sixth embodiment.

A sixth embodiment of the present invention will now be described. This is a modification of the fifth embodiment. FIG. 9 shows a side view, partially in cross section, of a fuel delivery system in which the fuel delivery pipe of the first embodiment is used. In this embodiment, an o-ring 110 is used as a sealing member in place of the sealing rubber 102 of the fifth embodiment. Around the utmost end of the lower end 105 of the fuel injector 4, a circular projection 111 is defined to prevent the o-ring 110 from falling out in place of the engaging member 104 of the fifth embodiment. The number of parts used in this embodiment is less than that used in the fifth embodiment, thus resulting in lower cost.

Figure 10:
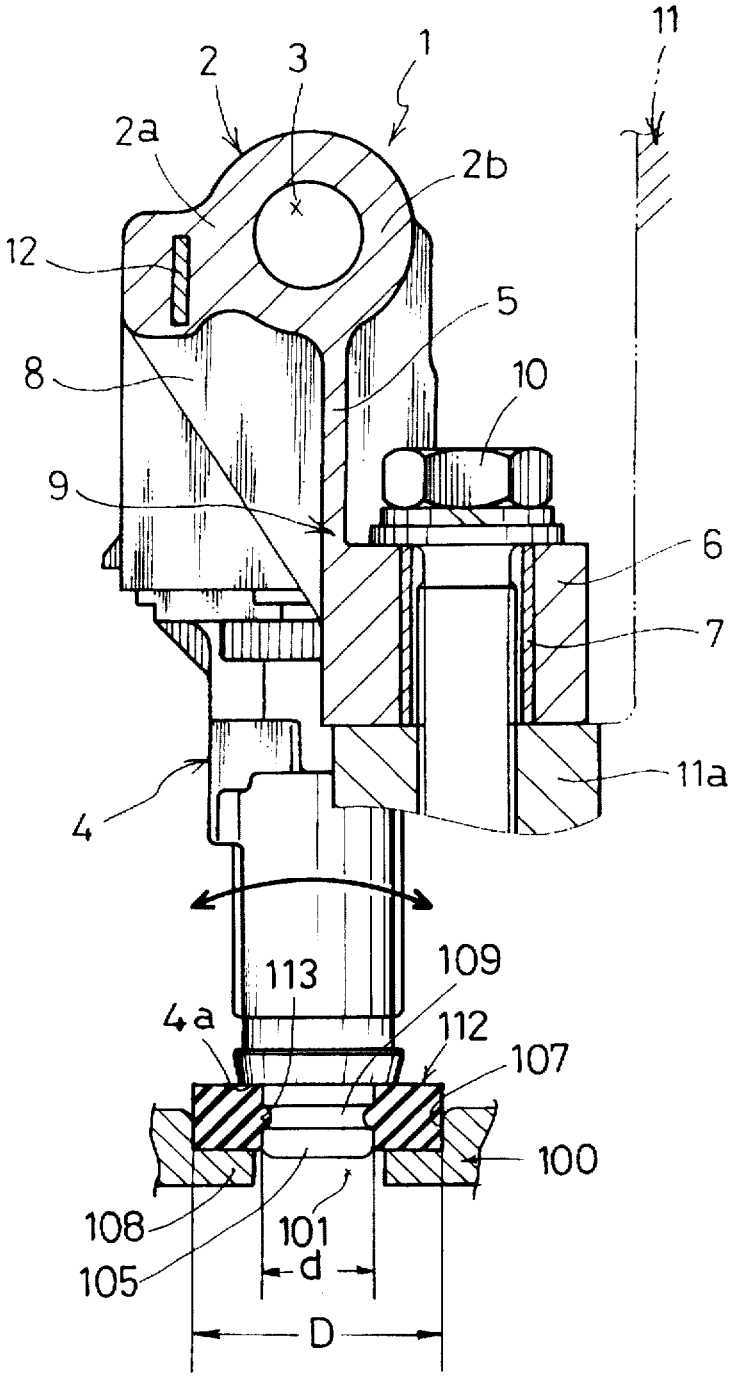
FIG. 10 is a side view, shown partially in cross-section, of a fuel delivery system of a seventh embodiment.

A seventh embodiment of the present invention will now be described. This is another modification of the fifth embodiment. FIG. 10 shows a side view, partially in cross section, of a fuel delivery system in which the fuel delivery pipe of the first embodiment is used. A sealing rubber 112 of this embodiment has a plane outer peripheral surface in place of the beats 103 of the sealing rubber 102. The inner peripheral surface of the sealing rubber 112 is formed with an engaging convex beat 113 in a ring-like manner. At the lower end 105 of the fuel injector 4, an engaging concavity 109 is formed corresponding to the engaging beat 113 of the sealing rubber 112 in place of the snap-fitting concavity 106 of the fifth embodiment. The mounting hole 101 of the intake manifold 100 is formed to have a step to serve as a seat 108 on which the bottom periphery of the sealing rubber 112 is seated for sealing.

This invention is not limited to the above-described embodiments and can be modified without departing from the scope of the present invention. For example, the fuel delivery pipe 1 may not have the printed board. In place of the reinforcing member 13, a rib or a protector can be used. Any of the fuel delivery pipes of the embodiments 5 to 7 may be replaced by any of the fuel delivery pipes of the embodiments 2 to 4.

According to the fuel delivery system of the present invention, when an abnormally large force is applied between the fuel delivery pipe and the engine, the weak portion is broken first to prevent the pipe from damaging, thus preventing fuel leakage by damage of the pipe of the fuel delivery pipe.

What is claimed is:

1. A fuel delivery system for delivering fuel to an engine comprising:

a pipe having a fuel passage and a plurality of fuel injector mounting holes each mounting hole communicating with the fuel passage;

a plurality of fuel injectors, each fuel injector mounted on a fuel injector mounting hole; and a mounting portion for fixing said pipe to said engine, so that each fuel injector mounted on said mounting hole is positioned in a predetermined positional relation with respect to the engine when said pipe is fixed to said engine by mounting portion, the mounting portion having a weak portion, wherein a fracture strength of the pipe is larger than the fracture strength of the weak portion and the mounting strength of each fuel injector with respect to said pipe is predetermined to be larger than the mounting strength of a fuel injector with respect to the engine.

2. The fuel delivery system as defined in claim 1, wherein said pipe and said mounting portion is integrally formed of resin.

3. The fuel delivery system as defined in claim 1, wherein said weak portion is provided by making said mounting portion thinner than the peripheral wall thickness of the pipe.

4. The fuel delivery system as defined in claim 1, wherein the weak portion is provided by forming a notch in said mounting portion.

5. The fuel delivery system as defined in claim 2, wherein a conductive member for connecting a connector to said plurality of fuel injectors is insert-molded within said pipe.

6. The fuel delivery system as defined in claim 5, wherein said conductive member is insert-molded within a wall of said pipe on a side remote from said engine.

7. The fuel delivery system as defined in claim 1, wherein a reinforcing member is insert-molded into said pipe.

* * * * *

UNITED STATES PATENT AND TRADEMARK OFFICE

CERTIFICATE OF CORRECTION

PATENT NO. : 5,735,247

DATED : April 7, 1998

INVENTOR(S) : Touji TSUZUKI et al

It is certified that error appears in the above-identified patent and that said Letters Patent is hereby corrected as shown below:

Title page:

[30] Foreign Application Priority Data, should read--

March 1, 1996 [JP] Japan.....8-44718
November 22, 1996 [JP] Japan.....8-312221

Signed and Sealed this

Sixth Day of April, 1999

*Attest:*

*Attesting Officer*

Q. TODD DICKINSON

*Acting Commissioner of Patents and Trademarks*